United States Patent [19]

Obuch et al.

[11] 3,930,706

[45] Jan. 6, 1976

[54] CIRCUIT PANEL CONNECTOR

[75] Inventors: Edward A. Obuch, Linden; William T. Waddington, Fanwood, both of N.J.

[73] Assignee: Amerace Corporation, New York, N.Y.

[22] Filed: June 28, 1974

[21] Appl. No.: 484,168

[52] U.S. Cl. .. 339/64 M; 339/176 MP; 339/184 M; 339/272 R

[51] Int. Cl.[2] ..... H01R 13/50

[58] Field of Search ..... 339/64 R, 64 M, 176 R, 339/176 M, 176 MP, 176 MF, 184 R, 184 M, 272 R, 272 A, 272 UC

[56] References Cited

UNITED STATES PATENTS

| | | | |
|---|---|---|---|
| 2,765,450 | 10/1956 | Richardson | 339/176 MP |
| 2,935,725 | 5/1960 | Fox | 339/176 MP |
| 3,075,167 | 1/1963 | Kinkaid | 339/176 MP |
| 3,270,313 | 8/1966 | Sautois | 339/176 MP |
| 3,296,576 | 1/1967 | Motten | 339/64 M |
| 3,346,835 | 10/1967 | Burniston | 339/272 R |
| 3,660,803 | 5/1972 | Cooney | 339/176 MP |
| 3,775,733 | 11/1973 | Ege | 339/272 R |

*Primary Examiner*—Roy Lake
*Assistant Examiner*—Mark S. Bicks
*Attorney, Agent, or Firm*—S. Michael Bender; Richard A. Craig; Gregory J. Battersby, Jr.

[57] ABSTRACT

A circuit panel connector for enabling the connection of a plurality of circuit terminals at the edge of a circuit panel, such as a printed circuit board, with external conductors includes an elongate socket and self-aligning bifurcated electrical contacts juxtaposed with the socket along the length thereof, each having a pair of opposed cantilever tines integral with a common base and carrying contact lobes at the free ends thereof such that both tines are free to flex resiliently relative to one another for the reception of the circuit panel edge between the tines, while the contacts are free to move laterally, relative to the socket, for alignment of the contacts with the circuit panel edge in response to insertion of the circuit panel edge within the socket, and a strap integral with the base of each contact and extending laterally into a tubular connector element having means for releasably clamping an external conductor against the strap within the tubular connector element.

11 Claims, 4 Drawing Figures

CIRCUIT PANEL CONNECTOR

The present invention relates generally to electrical connectors and pertains, more specifically, to electrical connectors of the type which serve as an interface between a circuit panel, such as a printed circuit board, and external conductors.

The increasing use of modular construction in electric and electronic devices and, in particular, the use of pre-wired circuit panels, such as printed circuit boards, in modular construction has led to a demand for electrical connectors capable of making ready electrical connections between such panels and external conductors. Thus, for example, printed circuit boards frequently are constructed with a plurality of circuit terminals located adjacent one edge of the board. That edge is then placed within a connector in the form of a terminal block having contacts which engage the terminals of the printed circuit. External conductors are affixed to the terminal block for electrical connection to the terminals of the printed circuit through the terminal block.

Terminal blocks of the type having contacts which enable ready connection and disconnection of external conductors to various circuits have been in use for quite some time. In such terminal blocks, means are provided, usually in the form of a clamping screw, for selectively clamping or releasing an external conductor to connect or disconnect the conductor and the contact of the terminal block. Such means have been employed in connectors which enable the selective connection of external conductors to printed circuit boards; however, existing connectors of that type do not appear to take into account some of the critical factors in successfully accommodating a complete circuit panel, such as a printed circuit board, within a single connector and a plurality of separate external conductors which individually can be selectively connected to or disconnected from the connector.

It is an object of the present invention to provide a connector which enables the selective insertion or removal of a circuit panel, such as a printed circuit board, into or out of the connector and enables the selective connection or disconnection of external conductors to or from the connector with increased ease, reliability and accuracy.

Another object of the invention is to provide a connector of the type described in which bifurcated contacts receive the edge of the circuit panel and align themselves within the connector relative to the panel edge in response to the reception of the panel edge in the connector to enable effective electrical contact with the circuit panel terminals located adjacent the edge of the panel.

Still another object of the invention is to provide a connector of the type described wherein external conductors of a variety of sizes may be inserted into the connector with ease and wherein positive connection is assured and, further, may be ascertained visually.

A further object of the invention is to provide a connector of the type described which is supplied in fully assembled configuration and need not be disassembled either in whole or in part when put to use.

A still further object of the invention is to provide a connector of the type described which exhibits a high degree of dielectric integrity and in which all electrically conductive component parts are recessed or otherwise placed remote from the external surfaces of the connector so as to reduce the hazards of electric shock or short circuit conditions.

Another object of the invention is to provide a connector of the type described which may be keyed selectively to assure proper mating of a particular circuit panel without disassembly of the connector.

A further object of the invention is to provide a connector which is relatively simple in construction and is capable of economical manufacture in large numbers and of varied sizes.

The above objects, as well as still further objects and advantages, are attained by the invention which may be described briefly as a circuit panel connector for enabling connection of the circuit terminals along the edge of a circuit panel, such as a printed circuit board, with external conductors, the panel connector comprising a body of dielectric material, an elongate socket in the body for receiving the panel edge, the socket having opposite side walls and a bottom, a plurality of bifurcated electrical contacts in the body, the contacts each having a base juxtaposed with the bottom of the socket and opposed tines juxtaposed with the side walls and including contact members projecting beyond the side walls into the socket, a plurality of connector elements, one for each bifurcated contact, each connector element being captured within the body against movement relative thereto and being spaced laterally from a corresponding bifurcated contact, a conductive strap integral with the base of the bifurcated contact and extending from the base to the connector element, and means for releasably clamping an external conductor to the connector element and in electrical contact with the strap, each tine being spaced from the corresponding side wall with which the tine is juxtaposed to enable lateral movement of the bifurcated contact relative to the body and resilient flexing of both tines away from one another in response to entry of the panel edge between the contact members of the tines.

The invention will be more fully understood, while still further objects and advantages will become apparent, in the following detailed description of a preferred embodiment of the invention illustrated in the accompanying drawing, in which.

Figure 1:
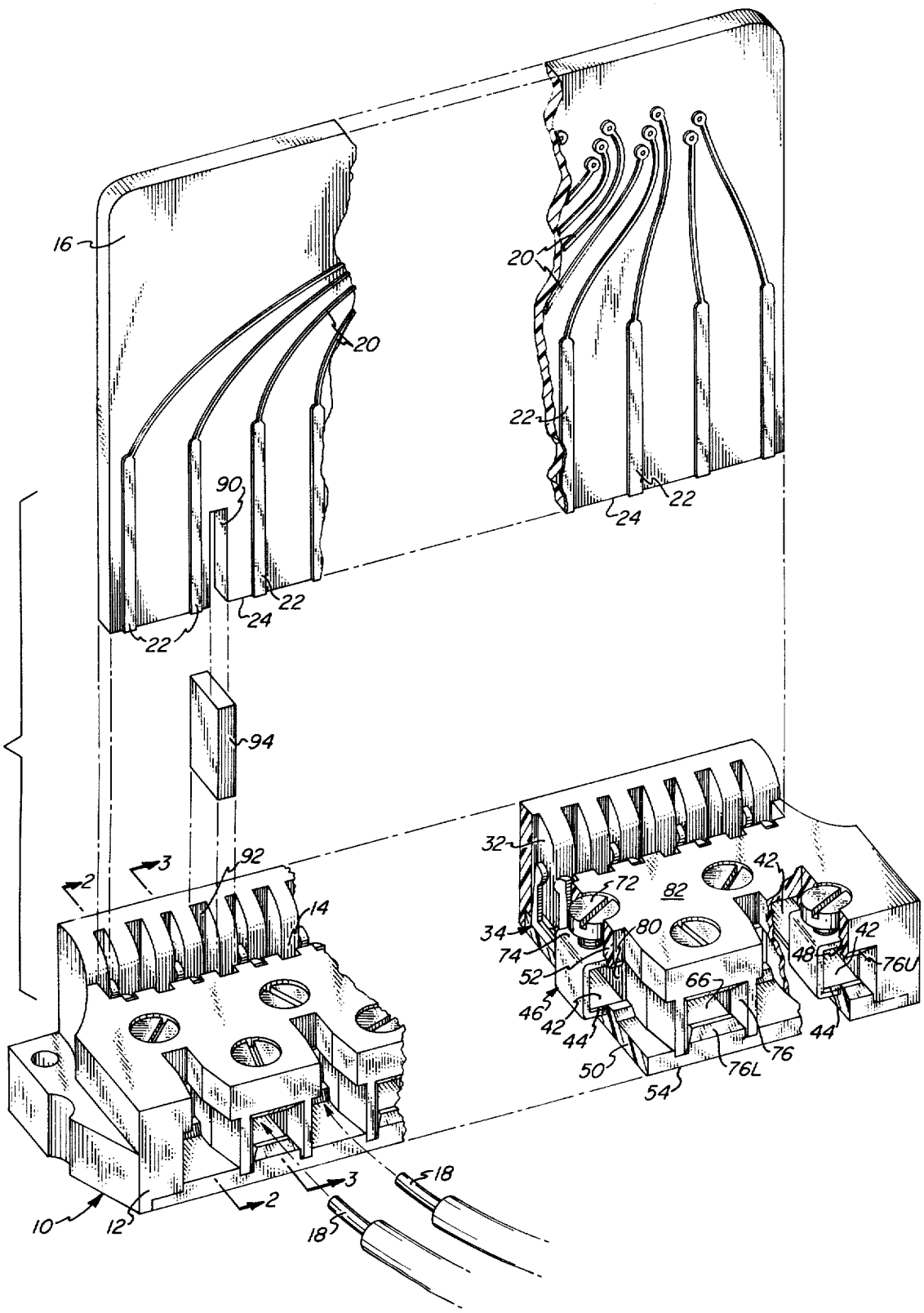
FIG. 1 is a partially exploded, partially broken away, perspective view illustrating a connector constructed in accordance with the invention about to receive a circuit panel and external conductors.

Referring now to the drawing, and especially to FIG. 1 thereof, a connector constructed in accordance with the invention is illustrated at 10 and is seen to include a body 12 of dielectric material having an elongate socket 14 extending in a longitudinal direction along almost the entire length of the body 12. Connector 10 is to be employed as an interface device to connect a circuit panel, shown in the form of a printed circuit board 16, to a plurality of external conductors 18. More specifically, the printed circuit board 16 carries circuitry 20 which includes a plurality of terminals 22 located along a line adjacent one edge 24 of the printed circuit board 16 and each of these terminals 22 is to be connected to a corresponding conductor 18 via the connector 10.

Figure 2:
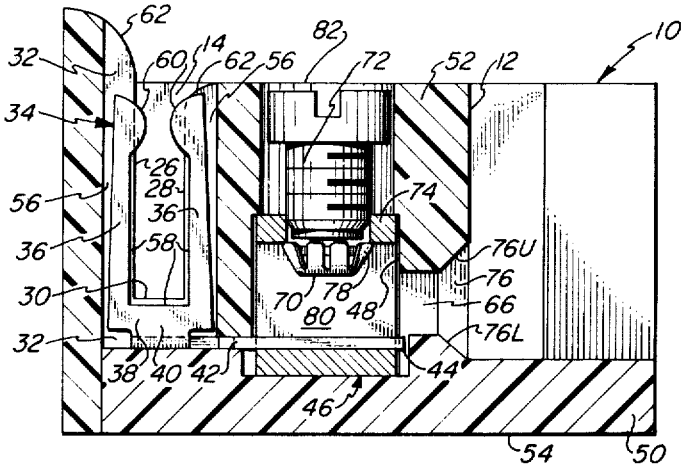
FIG. 2 is a lateral cross-sectional view taken along line 2—2 of FIG. 1.
Figure 3:
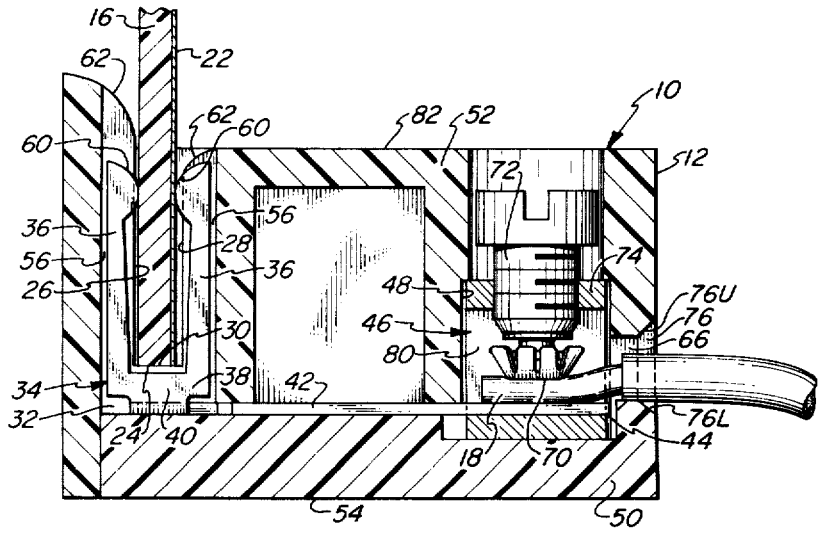
FIG. 3 is a lateral cross-sectional view taken along line 3—3 of FIG. 1, but with the circuit panel and an external conductor received within the connector.

Turning now to FIGS. 2 and 3, as well as to FIG. 1, socket 14 is generally complementary to the edge 24 of printed circuit board 16 and includes opposite side walls 26 and 28 and a bottom 30. A plurality of U-shaped grooves 32 are placed in the body 12, one for each connection to be made, the grooves 32 extending along the walls 26 and 28 and bottom 30 and opening into the socket 14.

Figure 4:
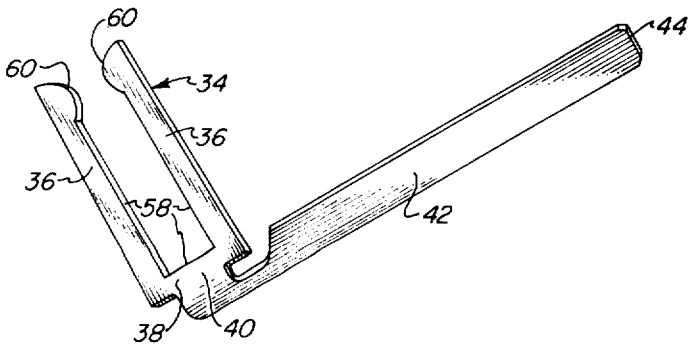
FIG. 4 is a perspective view of a bifurcated contact of the connector.

A bifurcated electrical contact 34 is placed in each groove 32, each contact 34 having a pair of opposed tines 36 unitary with a base 38 thereby establishing a generally U-shaped configuration. The central portion 40 of the base 38 is unitary with an elongate strap 42, as best seen in FIG. 4, and the strap extends laterally through the body 12 so that the free end 44 thereof enters a generally tubular connector element 46.

Each connector element 46 is held captive within a cavity 48 in the body 12 of the connector 10 wherein the connector element 46 is retained against upward or downward movement (as viewed in FIGS. 2 and 3), lateral movement (to the left or right as viewed in FIGS. 2 and 3) or longitudinal movement (perpendicular to the plane of the paper in FIGS. 2 and 3) relative to the body 12. As best seen in FIGS. 2 and 3, body 12 includes a separate lower body portion 50 integral with the upper body portion 52 thereof. Prior to affixing lower body portion 50 to the upper body portion 52, each of the bifurcated contacts 34 and the connector elements 46 are placed in the respective grooves 32 and cavities 48. The lower and upper body portions 50 and 52 are then permanently affixed to one another, fixing the contacts and connector elements in place and effectively electrically insulating the contacts and connector elements from the basal surface 54 of the body 12. It is noted that the straps 42 are of two different lengths and the cavities 48 are in two rows staggered from one another so that adjacent connector elements 46 are somewhat nested, thereby enabling a maximum size for the connector elements with a minimum length of body 12.

Referring now to FIG. 2, each U-shaped bifurcated contact 34 is received within a corresponding U-shaped groove 32 with a certain amount of clearance space 56 between each of the tines 36 and the corresponding side walls 26 and 28. The inner edges 58 of the contact 34 are recessed relative to the socket 14 with the exception of a pair of opposed contact members shown in the form of opposed rounded lobes 60 located at the free ends of the tines 36 and projecting into the socket 14. The central portion 40 of the base 38 of contact 34 rests upon the lower body portion 50 and can slide laterally, relative to the fixed connector element 46, by virtue of clearance spaces 56 and the free entry of end 44 of strap 42 into the connector element 46. The entrance surfaces 62 at the entrance to socket 14 are also rounded thereby providing a flared entrance so that as the edge 24 of printed circuit board 16 is inserted into the socket 14, the lobes 60 of tines 36 will be engaged without stubbing. The printed circuit board 16 will thus enter between the lobes 60 of tines 36 and, as the edge 24 engages the lobes 60, the contacts 34 will be moved laterally relative to the body 12 so that each contact will align itself in the optimum position for accepting the printed circuit board. Hence, the contacts 34 are self-aligning for optimum contact pressure, as will be described below.

Turning now to FIG. 3, when the printed circuit board 16 is fully inserted into socket 14, with edge 24 resting against the bottom 30 of the socket 14, electrical contact is made between a lobe 60 and a corresponding terminal 22 of the circuitry 20 on printed circuit board 16. Proper contact pressure is attained by the resilient flexing of tines 36 relative to base 38 of the contact 34.

It is noted that each tine 36 is a cantilever member affixed at the lower end thereof to the base 38 so that each tine may flex equally and independent of any further structure. By thus distributing the total deflection available between the tines to both tines equally, the total available deflection is increased while the deflection of each tine is limited to resilient elastic deflection. Thus, the combined effect of the lateral movement of each contact 34 to align the contact with the edge of the printed circuit board, together with the equal deflection of both tines toward and away from one another provides optimum contact pressure between the lobes 60 of contacts 34 and any printed circuit board which can be inserted into socket 14. The particular configuration of the contact 34, wherein the strap 42 is unitary with the central portion 40 of base 38 of the contact 34, provides the desired freedom of deflection of both tines 36 without interference from the strap, while still enabling lateral displacement of the contact 34, with strap 42, for self-aligning purposes. The strap 42 is relatively rigid so that the free end 44 slides relative to that connector element 46 during alignment of the contact 34; however, such sliding movement is unnecessary to enable appropriate flexing of the tines relative to base 38 after the contact 34 is aligned with the printed circuit board 16. The connection between the strap 42 and base 38 at central portion 40 is also relatively rigid so that sliding movement of contact 34 and the flexing movement of tines 36 are independent of one another, thereby minimizing deleterious stresses.

Once the printed circuit board 16 is in place within socket 14, the external conductors 18 may be attached to the connector. Each conductor 18 is merely inserted through a corresponding opening 66 in the front of body 12 so as to be placed within the appropriate connector element 46, with the conductor 18 lying between the end 44 of strap 42 and a clamping means shown in the form of a pressure plate 70 carried at the end of a screw 72 threaded through the upper wall 74 of the connector element 46. Preferably, the connector element 46 has a rectangular tubular cross-sectional configuration which provides the optimum flat surfaces for locating and clamping the strap 42 and the conductor 18 in place within the connector element. Downward movement of the screw 72 will urge pressure plate 70 into clamping engagement with conductor 18 to secure the conductor in place in the connector 10 and to establish the desired electrical connection between the conductor 18 and the corresponding terminal 22 of the circuitry 20 of printed circuit board 16.

Beveled edge surfaces 76 are provided at each opening 66 so as to establish a funneled entry into the opening 66, thereby facilitating insertion of conductor 18. It is noted that when screw 72 is fully retracted, as shown in FIG. 2, no obstruction is present in the path of the conductor 18 as it is inserted through opening 66 into the connector element 46. The screw 72 is held captive in the connector element by virtue of resilient tabs 78 on pressure plate 70 which preclude withdrawal of the screw 72 from wall 74 and which also engage the side walls 80 of the connector element 46 to preclude rotation of the pressure plate 70 as the screw is rotated to urge pressure plate 70 against the conductor 18. Thus, the screw 72 and pressure plate 70 are recessed within the body 12 behind upper beveled surface 76U, relative to opening 66. Likewise, the end 44 of each strap 42 is recessed within the body 12 behind lower beveled surface 76L. In this manner, a conductor 18 passed through opening 66 will clear both the pressure plate 70 and the end 44 of strap 42 to assure ease of insertion and proper relationship between the conductor, the pressure plate and the strap.

When the conductors 18 are all attached, the screws 72 will be recessed relative to the upper surface 82 of the body 12, as illustrated in FIG. 3. The recessed screws provide an additional measure of protection against electric shock. In addition, the recessed screws provide a visual indication that the conductors are clamped within the connector elements.

As described above, the contacts 34 are aligned by insertion of the printed circuit board 16 prior to clamping of the conductors 18 against straps 42. The printed circuit board 16 may be removed subsequently, and re-inserted at any time and the contacts will remain in their initial alignment, having been clamped in place by the securement of conductors 18.

In order to assure that printed circuit board 16 is the appropriate board for mating with connector 10, the board 16 is provided with a keying notch 90 (see FIG. 1) located between adjacent terminals 22 at a selected location along edge 24. The socket 14 is provided with slots 92 located between adjacent grooves 32. A key 94 is placed within a selected slot 92 to match the location of notch 90 in edge 24 of board 16. Thus, only a board having a notch 90 at the appropriate longitudinal location will be able to enter socket 14 when key 94 is in place. By choosing the appropriate location for a key 94 and a notch 90, or any combination of locations, entry will be restricted to only those boards having the appropriate notch locations. Likewise, appropriate orientation of the board within the socket is assured. It is noted that a key 94 may be located in any slot 92 without disassembly of any component parts of the connector 10. Thus, the lower and upper body portions 50 and 52, once assembled, remain assembled, providing a high degree of dielectric integrity.

It is to be understood that the above detailed description of an embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A circuit panel connector for enabling connection of the circuit terminals along the edge of a circuit panel, such as a printed circuit board, with external conductors, said panel connector comprising:

a body of dielectric material;

an elongate socket in the body for receiving said panel edge, the socket having opposite side walls and a bottom;

a plurality of bifurcated electrical contacts in the body, the contacts each having a base juxtaposed with the bottom of the socket and opposed tines juxtaposed with the side walls and including contact members projecting beyond the side walls into the socket;

a plurality of tubular connector elements, one for each bifurcated contact, each connector element being captured within the body against movement relative thereto and being spaced from a corresponding bifurcated contact;

a conductive strap integral with the base of the bifurcated contact, said strap being recessed within the body and extending from the base to the tubular connector element, said strap being received within a corresponding tubular connector element and being adapted to slide relative to the corresponding tubular connector element upon lateral movement of the corresponding bifurcated contact; and means cooperating with each said tubular connector element for releasably clamping an external conductor to the connector element and in electrical contact with the strap, said body including an opening juxtaposed with each tubular connector element such that an external conductor will be guided through the opening and received within the tubular connector element between the strap and the clamping means;

each tine being spaced from the corresponding side wall with which the tine is juxtaposed to enable lateral movement of the bifurcated contact relative to the body and resilient flexing of both tines away from one another in response to entry of the panel edge between the contact members of the tines.

2. The invention of claim 1 wherein the tubular connector elements have a rectangular cross-sectional configuration.

3. The invention of claim 1 wherein the integral connection between the strap and the base of the bifurcated contact is relatively rigid.

4. The invention of claim 1 wherein the clamping means include a screw threaded in the tubular connector element for advancement into clamping position, said screw being recessed within said body when in the clamping position.

5. The invention of claim 1 wherein the clamping means is recessed within the body relative to the opening.

6. The invention of claim 5 wherein the opening includes beveled edges for providing a funneled entry for the external conductor into the tubular connector element, the strap and the clamping means being recessed behind said beveled edges.

7. The invention of claim 1 wherein the contact members are rounded lobes unitary with the tines at an end of the tines opposite to the common base.

8. The invention of claim 7 wherein the socket includes an entrance, said entrance being flared to facilitate entry of the circuit panel edge, said lobes being juxtaposed with the flared entrance to facilitate entry of the circuit panel edge between the lobes.

9. The invention of claim 1 wherein the body includes a plurality of slots, each slot being located between adjacent bifurcated contacts along the socket for receiving a key selectively insertable therein to assure correct circuit panel insertion.

10. The invention of claim 9 wherein the body comprises upper and lower body portions permanently affixed to one another.

11. The invention of claim 1 wherein the body comprises upper and lower body portions permanently affixed to one another, the lower body portion including a basal surface electrically insulated from the contacts and connector elements by the dielectric material of the said body.

* * * * *